US005485819A

United States Patent [19]

Joko et al.

[11] Patent Number: 5,485,819

[45] Date of Patent: Jan. 23, 1996

[54] INTERNAL COMBUSTION ENGINE

[75] Inventors: Isao Joko; Toshiaki Kakegawa; Seiji Shundo, all of Hino, Japan

[73] Assignee: Hino Jidosha Kogyo Kabushiki Kaisha, Tokyo, Japan

[21] Appl. No.: 285,425

[22] Filed: Aug. 4, 1994

Related U.S. Application Data

[63] Continuation-in-part of Ser. No. 169,075, Dec. 20, 1993, Pat. No. 5,406,918.

[30] Foreign Application Priority Data

| | | | |
|---|---|---|---|
| Aug. 4, 1993 | [JP] | Japan | 5-211050 |
| May 23, 1994 | [JP] | Japan | 6-108406 |

[51] Int. Cl.[6] ..... F02D 13/04

[52] U.S. Cl. ..... 123/321

[58] Field of Search ..... 123/321, 90.18, 123/516, 629, 514, 90.16

[56] References Cited

U.S. PATENT DOCUMENTS

| | | | |
|---|---|---|---|
| 3,439,662 | 4/1969 | Jones et al. | 123/321 |
| 4,316,437 | 2/1982 | Bertrand | 123/90.18 |
| 4,384,558 | 5/1983 | Johnson | 123/321 |
| 4,423,712 | 1/1984 | Mayne et al. | 123/321 |
| 4,475,500 | 10/1984 | Bostelman | 123/321 |
| 4,741,307 | 5/1988 | Meneely | 123/321 |
| 4,836,162 | 6/1989 | Melde-Tuczai et al. | 123/321 |
| 4,932,372 | 6/1990 | Meneely | 123/182 |
| 4,984,554 | 1/1991 | Ariga et al. . | |
| 5,309,881 | 5/1994 | Pawellik et al. | 123/321 |

OTHER PUBLICATIONS

Article Titled Development of Auxiliary Engine Braking Device for a Heavy Duty Engine with 4–Valve System, in Jidosha Gijutsu, vol. 46, no. 10, 1992 with Abridged Translation.

*Primary Examiner*—Raymond A. Nelli

*Attorney, Agent, or Firm*—Oblon, Spivak, McClelland, Maier, & Neustadt

[57] ABSTRACT

An internal combustion engine has an engine-braking master piston for a first cylinder actuated by a first rocker arm which, in turn, is actuated by the inlet push rod of another cylinder and an exhaust-gas-recirculation master piston is provided which is actuated by a second rocker arm which, in turn, is actuated by the exhaust push rod of another cylinder. An oil passage selector valve is provided for selectively switching over the hydraulic pressures produced by the engine-braking master piston and exhaust-gas-recirculation master piston to an oil passage to actuate a slave piston and open an exhaust valve of the first cylinder. To effect engine braking, the exhaust valve of the first cylinder opens as the piston is near its top dead center position at the end of the compression stroke or at the beginning of the expansion stroke. To effect exhaust-gas-recirculation, the exhaust valve of the first cylinder opens as the piston is near the end of its suction stroke and part of the high pressure exhaust gases from the other cylinder flow back into the first cylinder.

8 Claims, 7 Drawing Sheets

INTERNAL COMBUSTION ENGINE

BACKGROUND OF THE INVENTION

The present invention is a continuation-in-part of Ser. No. 08/169,075 filed Dec. 20, 1993 and now U.S. Pat. No. 5,406,918, and relates to an internal combustion engine in which a compression engine brake device, which serves during engine braking to ensure a braking force by opening an exhaust valve of a cylinder near its piston's top dead center position in a compression stroke to discharge the compressed air, is utilized for exhaust gas recirculation.

DISCUSSION OF THE BACKGROUND

In a known internal combustion engine with an engine brake device as shown in FIG. 8, during engine braking, with an exhaust brake valve 10 closed, a master piston 2 for a cylinder 7 is actuated by a rocker arm 19. The rocker arm 19, in turn, is actuated by a push rod 1 of another cylinder (not shown) to pressurize oil supplied to oil passage 5 from a rocker shaft bracket through solenoid and control valves 3 and 4. Due to the hydraulic pressure thus produced in line 5, an exhaust valve 8 of the cylinder 7, near its piston's top dead center position, is opened via a slave piston 6 to discharge compressed air from cylinder 7 through exhaust port 9. As a result, the force for pushing down the piston is prevented and a braking force obtained in the compression stroke is effectively utilized with no loss.

In in-line 6-cylindered engines, three oil passages 5 are branched off from a single oil passage provided with a solenoid valve 3 and a control valve 4 is disposed in each of the oil passages 5. This allows the volume of each oil passage 5 to be reduced and enhances responsiveness of the slave piston 6.

An internal combustion engine having a conventional engine brake device described above may be effective for engine braking, but cannot attain recirculation of exhaust gases thereby failing to provide improvement with respect to the problems of $NO_x$ and of white smoke at engine starting. Particularly in a turbo-intercooled engine, exhaust gas recirculation is difficult to carry out.

SUMMARY OF THE INVENTION

It is an object of the present invention to provide an internal combustion engine which can solve the above problems.

To attain the above object, the present invention is directed to an internal combustion engine wherein during engine braking, a master piston for a cylinder is actuated by a rocker arm. That rocker arm, in turn, is actuated by a push rod of another cylinder to pressurize oil having been supplied to an oil passage. An exhaust valve of the one cylinder near its piston's top dead center position in a compression stroke is opened through a slave piston by the hydraulic pressure thus produced in the oil passage to discharge the compressed air in the cylinder through an exhaust port. In addition to said engine-braking master piston which is actuated by a rocker arm and which in turn is actuated by a push rod, an exhaust-gas-recirculation master piston is provided, which is actuated by a rocker arm which in turn is actuated by a push rod of said another cylinder thereby pressurizing oil supplied to said oil passage to open the exhaust valve in a suction stroke. An oil passage selector valve is provided which selectively switches over the hydraulic pressures produced by said master pistons to said oil passage.

In the above arrangement, engine braking and exhaust gas recirculation can be selectively effected by switching over the hydraulic pressures produced by the engine-braking and exhaust-gas-recirculation master pistons by means of the oil passage selector valve.

DESCRIPTION OF THE PREFERRED EMBODIMENTS

Figure 1:
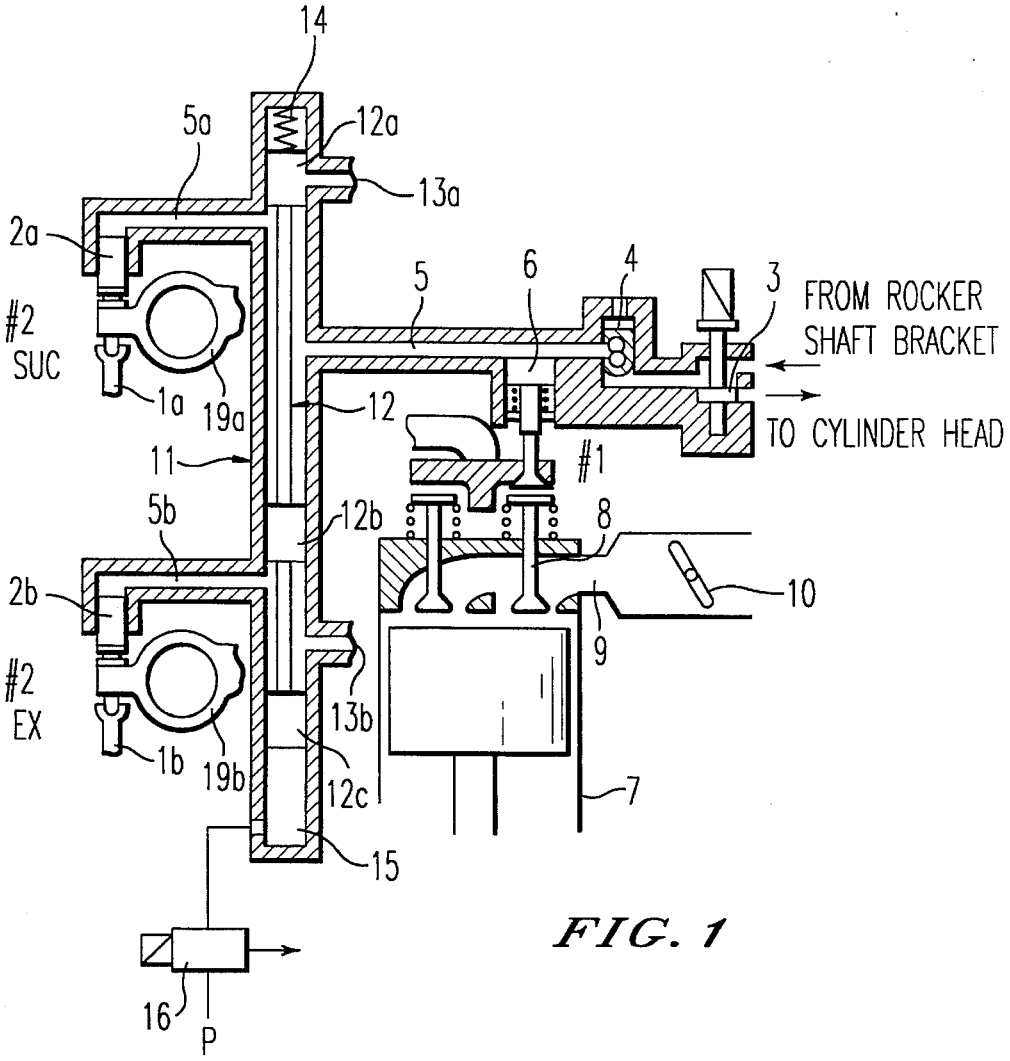
FIG. 1 is a sectional view of an embodiment of the present invention.

Embodiments of the present invention will be described in conjunction with the drawings, In FIG. 1, reference numeral 5 represents a first oil passage to which oil is supplied from a rocker shaft bracket through solenoid and control valves 3 and 4. A slave piston 6 opens exhaust valve 8 of a cylinder 7 depending upon the oil pressure in passage 5. Also shown is an exhaust brake valve 10.

Reference numerals 1*a* and 1*b* designate inlet and exhaust push rods of another cylinder respectively. Engine-braking master piston 2*a* and exhaust-gas-recirculation master piston 2*b* are actuated by rocker arms 19*a* and 19*b*, respectively. The rocker arms 19*a* and 19*b* are actuated by the inlet and exhaust push rods 1*a* and 1*b*, respectively. The master pistons 2*a* and 2*b*, when actuated, pressurize the oil which has been supplied to the oil passage 5 of the cylinder 7.

Reference numeral 11 represents an oil passage selector valve which selectively switches over the hydraulic pressures produced by the master pistons 2*a* and 2*b* to the oil passage 5. The selector valve 11 comprises a spool valve shaft 12 with a spool 12*a* for selectively communicating and cutting off a second oil passage 5*a* for the engine-braking master piston 2*a* with and from the first oil passage 5, a spool 12*b* for selectively communicating and cutting off third oil passage 5*b* for the exhaust-gas-recirculation master piston 2*b* with and from the first oil passage 5, and a piston 12*c*.

A switching mechanism for the oil passage selector valve 11 is constructed comprising a spring 14 which is loaded on one end of the spool 12*a* on one end of spool valve shaft 12. The switching mechanism further comprises a pressure source connected through an electromagnetic selector valve 16 to a chamber 15 closed on one end by piston 12*c* located at the other end of spool valve shaft 12. Switching of the selector valve 16 causes the shaft 12 to be axially displaced for selective opening and closing communication of the second and third oil passages 5*a* and 5*b*, respectively, with the first oil passage 5. Reference numerals 13*a* and 13*b* represent discharge passages.

Figure 2:
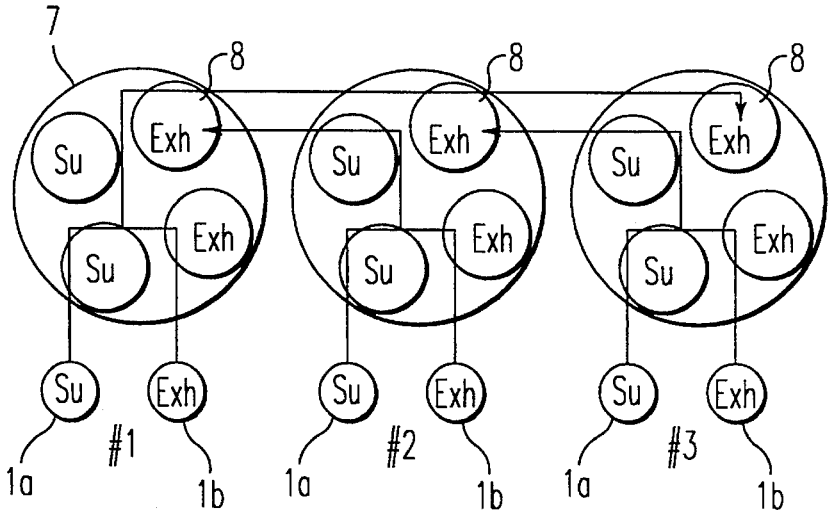
FIG. 2 is a view showing an arrangement with related cylinders in the embodiment of the present invention.

FIG. 2 shows an example of an application of the above embodiment to an in-line 6-cylindered engine where the exhaust valves 8 of the first, second and third cylinders #1(7), #2 and #3 are opening-controlled by the inlet and exhaust push rods 1*a* and 1*b* of the second, third and first cylinders #2, #3 and #1(7), respectively.

Next referring to FIGS. 1 and 2, the mode of operation of the above embodiment will be described with respect to the exhaust valve 8 of the first cylinder #1(7) opening-controlled by the push rods 1*a* and 1*b* of the second cylinder #2. During engine braking, i.e., when an exhaust brake switch (not shown) is on and a driver's foot is off the accelerator pedal (i.e., no pressure is applied to the accelerator pedal) during traveling, the selector valve 16 is switched so that oil under pressure is supplied to the chamber 15 and the third oil passage 5*b* for the exhaust-gas-recirculation master piston 2*b* is closed with respect to the first oil passage 5 while the second oil passage 5*a* for the engine-braking master piston 2*a* is in communication with the first oil passage 5.

Under the above condition, the engine-braking master piston 2*a* is actuated by the inlet push rod 1*a* of the second cylinder #2, which is then in its suction stroke, to pressurize the oil having been supplied to the first and second oil passages 5 and 5*a* from the rocker shaft bracket through the solenoid and control valves 3 and 4. Due to the hydraulic pressure thus produced, the exhaust valve 8 of the cylinder 7 (the first cylinder #1), which is finishing a compression stroke and beginning an expansion stroke, is opened through the slave piston 6 to discharge the compressed air through the exhaust port 9. As a result, force for pushing down the piston is prevented and the braking force is effectively utilized with no loss.

During exhaust gas recirculation (EGR), i.e., when the accelerator pedal is pressed to some extent and the engine is neither idling nor in a high loading condition during traveling, the selector valve 16 is switched so that the oil under pressure in the chamber 15 is discharged by resilient force of the spring 14. As a result, the oil passage selector valve 11 is switched so that the second oil passage 5*a* for the engine-braking master piston 2*a* is closed with respect to the first oil passage 5 while the third oil passage 5*b* for the exhaust-gas-recirculation master piston 2*b* is in communication with the first oil passage 5.

Under this condition, the exhaust-gas-recirculation master piston 2*b* is actuated by the exhaust push rod 1*b* of the second cylinder #2, which is in its exhaust stroke, to pressurize the oil having been supplied to the first and third oil passages 5 and 5*b* from the rocker shaft bracket through the solenoid and control valves 3 and 4. Due to the hydraulic pressure thus produced, the exhaust valve 8 of the cylinder 7 (the first cylinder #1) is opened at the end of the suction stroke via the slave piston 6.. Since as noted above, the second cylinder #2 is in its exhaust stroke, it has high pressure in its exhaust pipe. Part of those high pressure exhaust gases from the second cylinder #2 flow back to the cylinder 7 (the first cylinder #1) due to the pressure difference. Thus, exhaust gas recirculation (EGR) is effected to reduce $NO_x$ and improve the problem of white smoke at engine starting. This EGR is effective for turbo-intercooled engines in which exhaust manifold pressure pulsation, owing to exhaust strokes of each cylinder, is high.

Figure 3:
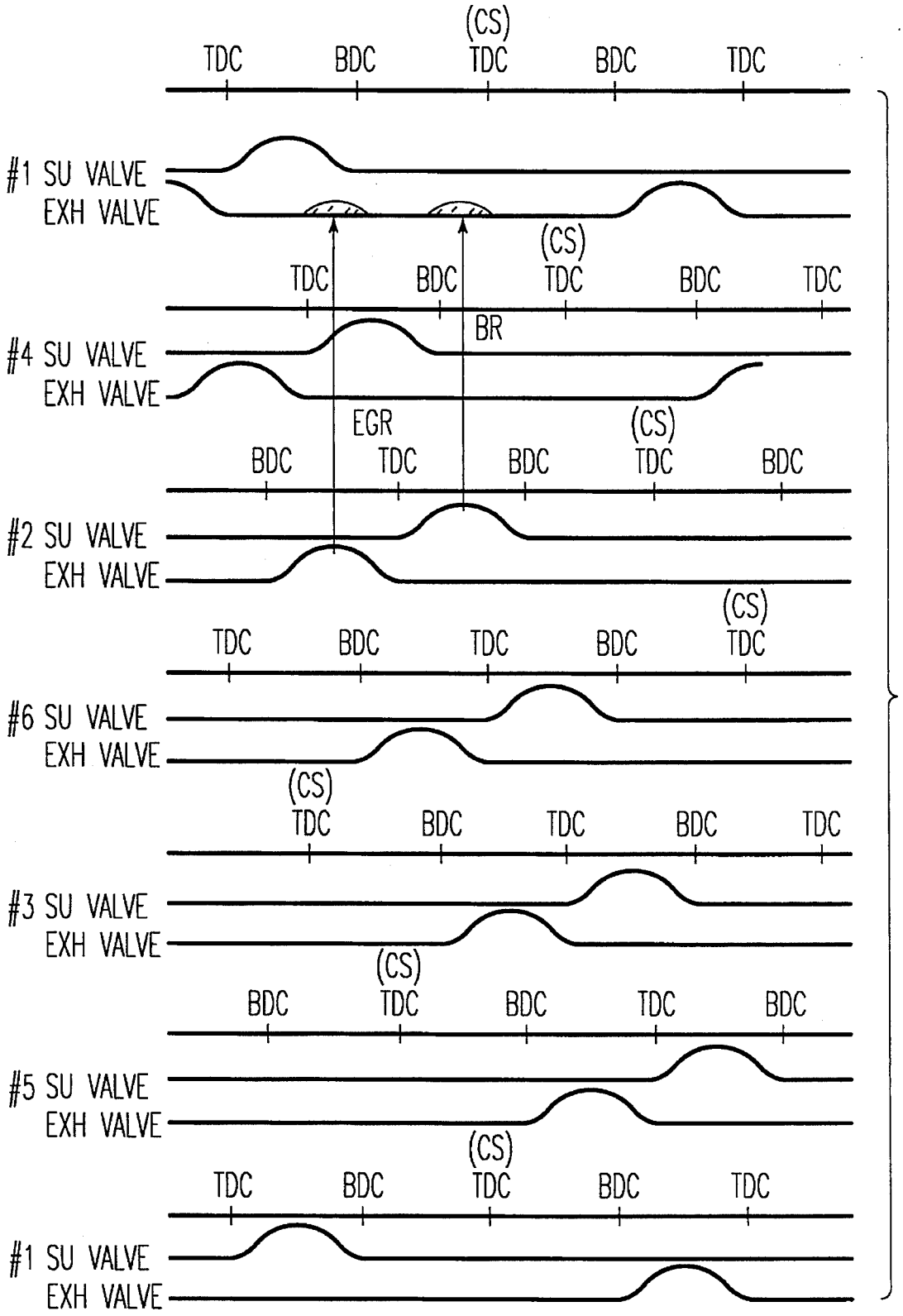
FIG. 3 is a diagram showing operation processes in the embodiment of the present invention.

Next referring to FIG. 3, the mode of operation of an in-line 6-cylindered engine to which the above embodiment is applied will be described. Valve lift is shown in the order of ignition #1, #4, #2, #6, #3 and #5. The exhaust valve of the first cylinder #1 is opening-controlled by the exhaust push rod of the second cylinder #2 and is opened near bottom dead center (BDC) of the first cylinder #1 to effect the exhaust gas recirculation (EGR). The exhaust valve of the first cylinder #1 is opened near top dead center (TDC) in the compression stroke of the first cylinder #1 by means of the inlet push rod of the second cylinder #2 to discharge the compressed air. As a result, force for pushing down the piston is prevented and the engine brake is actuated.

Exhaust gas recirculation may be also effected during engine starting for the purpose of air warming.

Figure 4:
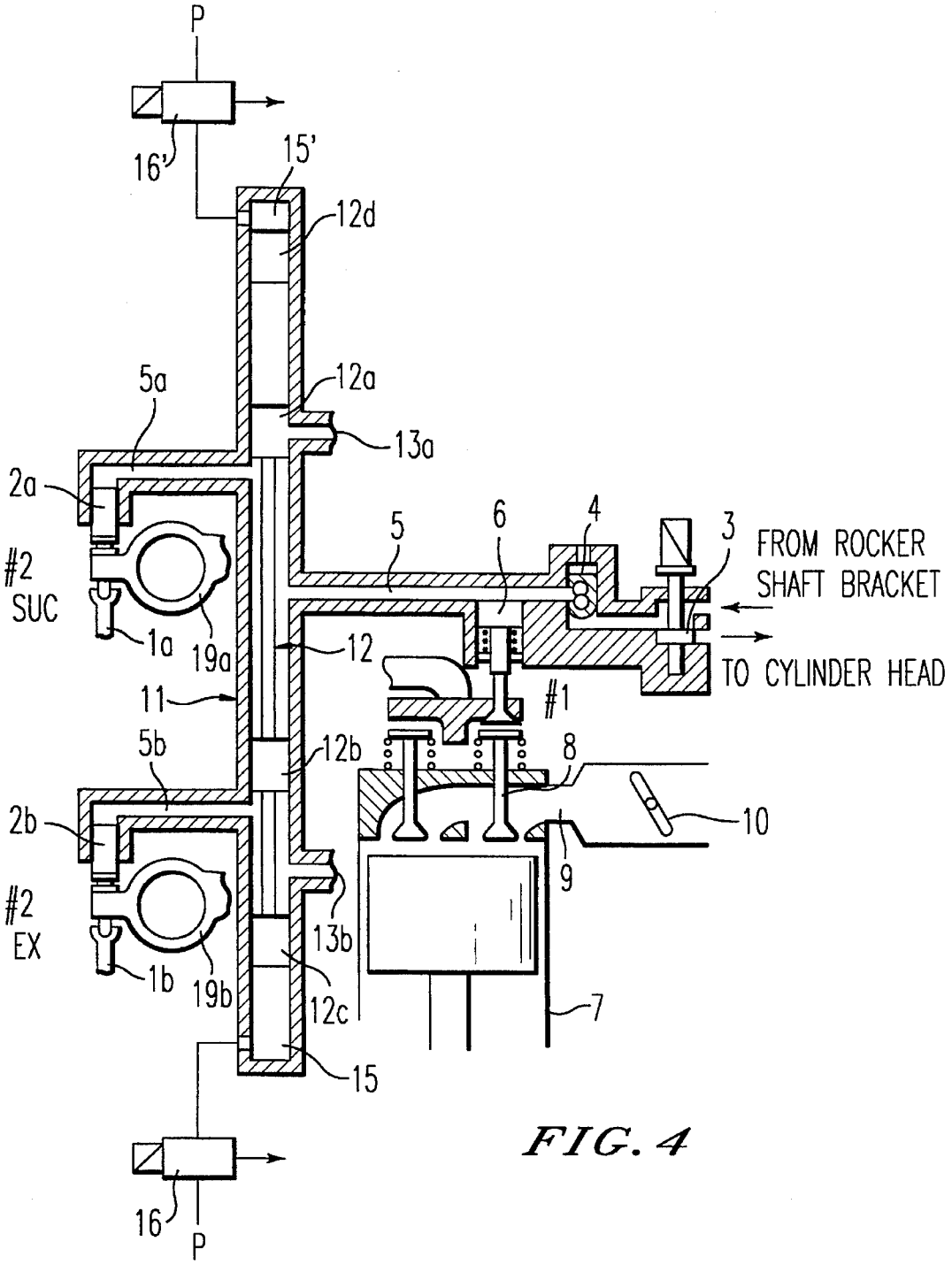
FIG. 4 is a sectional view of a further embodiment of the present invention.

FIG. 4 shows a further embodiment of the present invention where the same component as in FIG. 1 is referred to by the same reference numeral as in FIG. 1, and the basic arrangement is the same as in FIG. 1. In this embodiment, however, instead of providing a spring 14 (FIG. 1), the casing which forms the oil passage selector valve 11 is extended at that end and the spool valve shaft 12 is extended at its end closer to the spool 12*a* and provided with a piston 12*d* at its tip. A chamber 15' is closed on one end by the piston 12*d*. A pressure source is connected to the chamber 15' through an electromagnetic selector valve 16'.

In the embodiment of FIG. 4, during engine braking, i.e., when the exhaust brake switch (not shown) is on and no pressure is on the accelerator pedal during traveling, the selector valve 16 is switched over to supply oil under pressure to the chamber 15 and the electromagnetic selector valve 16' is switched over to discharge the oil under pressure in the chamber 15'. As a result, the oil passage selector valve 11 is switched so that the third oil passage 5*b* for the exhaust-gas-recirculation master piston 2*b* is closed with respect to the first oil passage 5 while the second oil passage 5*a* for the engine-braking master piston 2*a* is in communication with the first oil passage 5. On the other hand, during exhaust gas recirculation (EGR), i.e., when the accelerator pedal is pressed to some extent and the engine is neither idling nor in a high loading condition during traveling, the selector valve 16' is switched over to supply oil under pressure to the chamber 15' and the selector valve 16 is switched over to discharge the oil under pressure in the chamber 15. As a result, the oil passage selector valve 11 is switched so that the second oil passage 5*a* for the engine-braking master piston 2*a* is closed with respect to the first oil passage 5 while the third oil passage 5*b* for the exhaust-gas-recirculation master piston 2*b* is in communication with the first oil passage 5.

In the embodiment of FIG. 4, the switching of the oil passage selector valve 11 from the engine braking position to the exhaust-gas-recirculating position is effected, not by means of the spring 14 whose reaction force changes according to the position of the spool valve shaft 12 as shown in Fig. 1, but by means of hydraulic pressure so that the operation can be carried out in a more reliable and assured manner.

Figure 5:
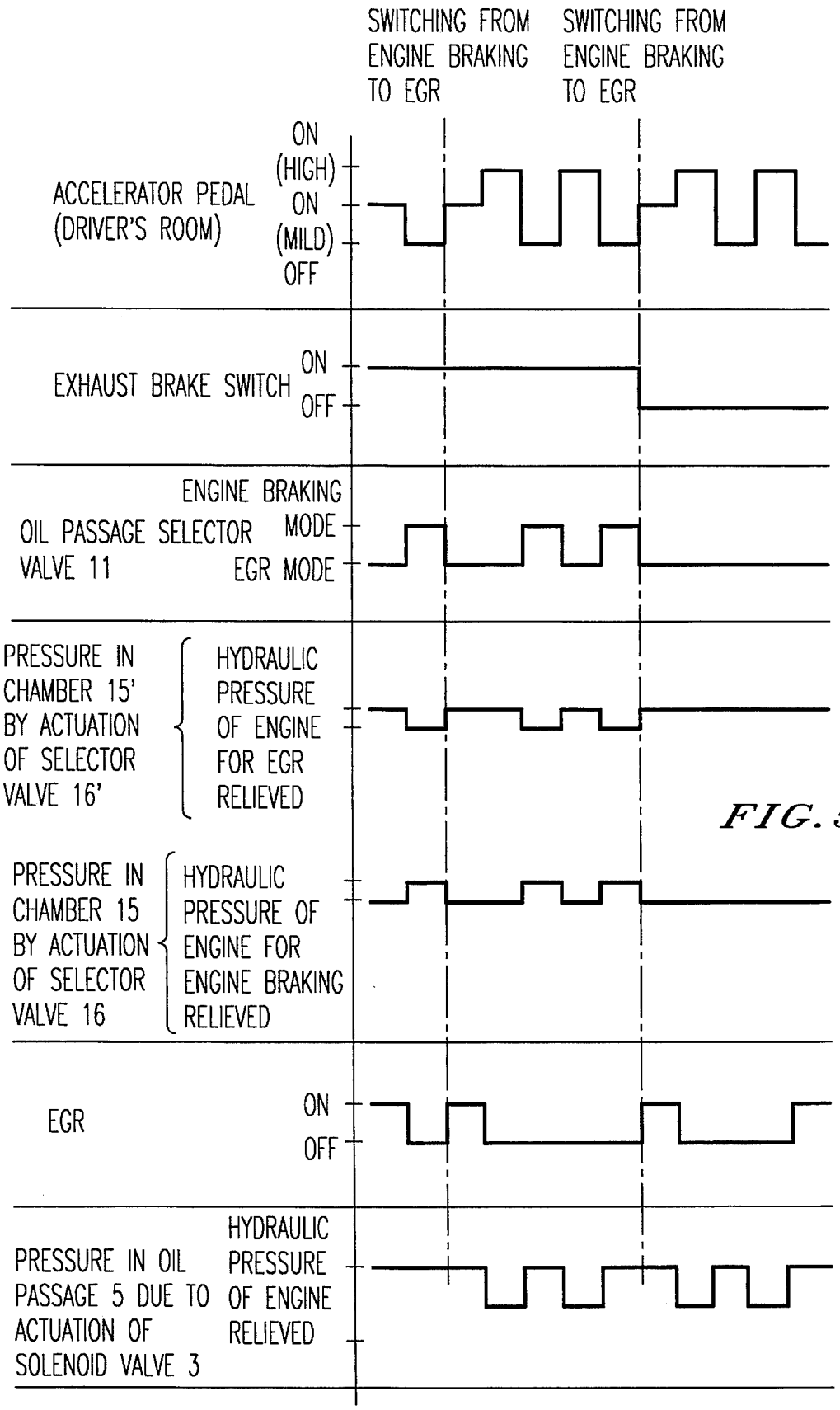
FIG. 5 is a chart showing the effect of accelerator pedal depression when using the embodiment of FIG. 4.

FIG. 5 shows a pattern of driving when using the structure shown in the embodiment of FIG. 4. Here, the extent of pressing the accelerator pedal is detected by an accelerator sensor under the following three conditions: idling state (OFF) with the accelerator pedal not being pressed at all, low to moderate loading condition (ON; mild) with the accelerator pedal being pressed to some extent, and high loading condition (ON; high) with the acceleration pedal being pressed strongly.

As is evident from FIG. 5, when the exhaust brake switch is on and no pressure is on the accelerator pedal, the electromagnetic valve 16 is switched over to supply oil under pressure to the chamber 15 and the electromagnetic valve 16' is switched over to discharge the oil under pressure in the chamber 15'. As a result, the oil passage selector valve 11 is switched so that the second oil passage 5*a* for the engine-braking master piston 2*a* is in communication with the first oil passage 5, i.e., the valve 11 is switched into a position for the engine braking mode. As described above, the exhaust valve 8 of the cylinder 7 in its expansion stroke is opened to discharge the compressed air through the exhaust port 9, whereby the force for pushing down the piston is prevented and the braking force is effectively utilized without loss. It is needless to say that EGR is not effected in this case.

When the condition of no pressure on the accelerator pedal is changed into the low to moderate loading condition with the accelerator pedal being pressed to some extent, then the selector valve 16' is switched over to supply oil under pressure to the chamber 15' and the selector valve 16 is switched over to discharge the oil under pressure in the chamber 15. As a result, the oil passage selector valve 11 is switched so that the second oil passage 5*a* for the engine-braking master piston 2*a* is closed with respect to the first oil passage 5 while the third oil passage 5*b* for the exhaust-gas-recirculation master piston 2*b* is in communication with the first oil passage 5, i.e., the valve 11 is switched into the position of EGR mode. Thus, EGR is effected as described above.

Further, when the condition of the accelerator pedal being pressed to some extent is changed into the high loading condition with the accelerator pedal being pressed strongly, then the pressures in the chamber 15' and 15 due to operation of the selector valves 16' and 16, respectively, are maintained without change and the oil passage selector valve 11 remains in the position corresponding to the EGR mode without change. However, a control signal is outputted from a controller (not shown) depending upon the driving condition of the engine so that the solenoid valve 3 is switched over to relieve the pressure in the first oil passage 5 and hydraulic pressure for opening the exhaust valve 8 is prevented when the accelerator pedal is pressed strongly. Therefore, EGR is not effected at that time.

In the case where the exhaust brake switch is off, the oil passage selector valve 11 is switched over to the EGR mode regardless of the extent at which the accelerator pedal is pressed. EGR is effected only when the engine is neither idling nor in a high loading condition, i.e., only when it is in the low to moderate loading condition. During that time, engine braking by opening the exhaust valve 8 is not effected.

As mentioned above, when the pressure on the accelerator pedal is changed from no pressure to the low to moderate loading condition with the accelerator pedal being pressed to some extent, the oil passage selector valve 11 is switched over from the position of engine braking mode to the position of EGR mode. However, since the rotating speed of the engine is low and engine hydraulic pressure supplied to the chamber 15' is low, the spool valve shaft 12 of the oil passage selector valve 11 has lowered responsiveness. As a result, engine braking, which is due to opening the exhaust valve 8 near top dead center of the compression stroke is continued for a slight period of time after the accelerator pedal is pressed which may confuse the driver. The driver's confusion does not occur when the condition of no pressure on the accelerator pedal is changed into the high loading condition with the accelerator pedal being pressed strongly and the selector valve 11 is switched over from the position of the engine braking mode to the position of the EGR mode. This is so since the solenoid valve 3 is switched over at that time to relieve the pressure in the oil passage 5, and the engine braking due to the opening of the exhaust valve 8 near top dead center of the compression stroke is immediately released. Also, no problem is found in the case where the EGR mode is changed into engine braking mode since the rotating speed of the engine is high and engine hydraulic pressure is ensured.

Figure 6:
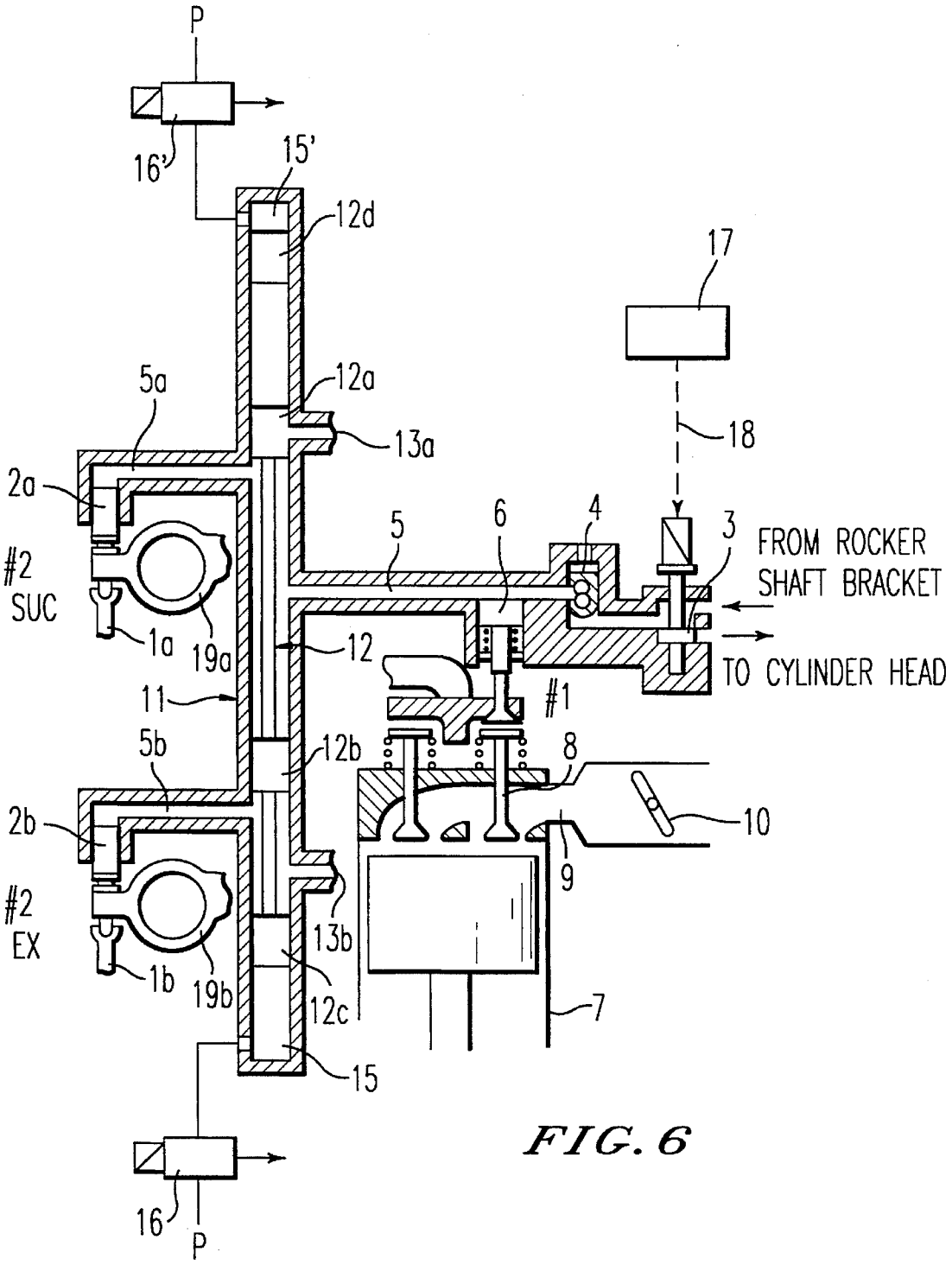
FIG. 6 is a sectional view of a still further embodiment of the present invention.
Figure 7:
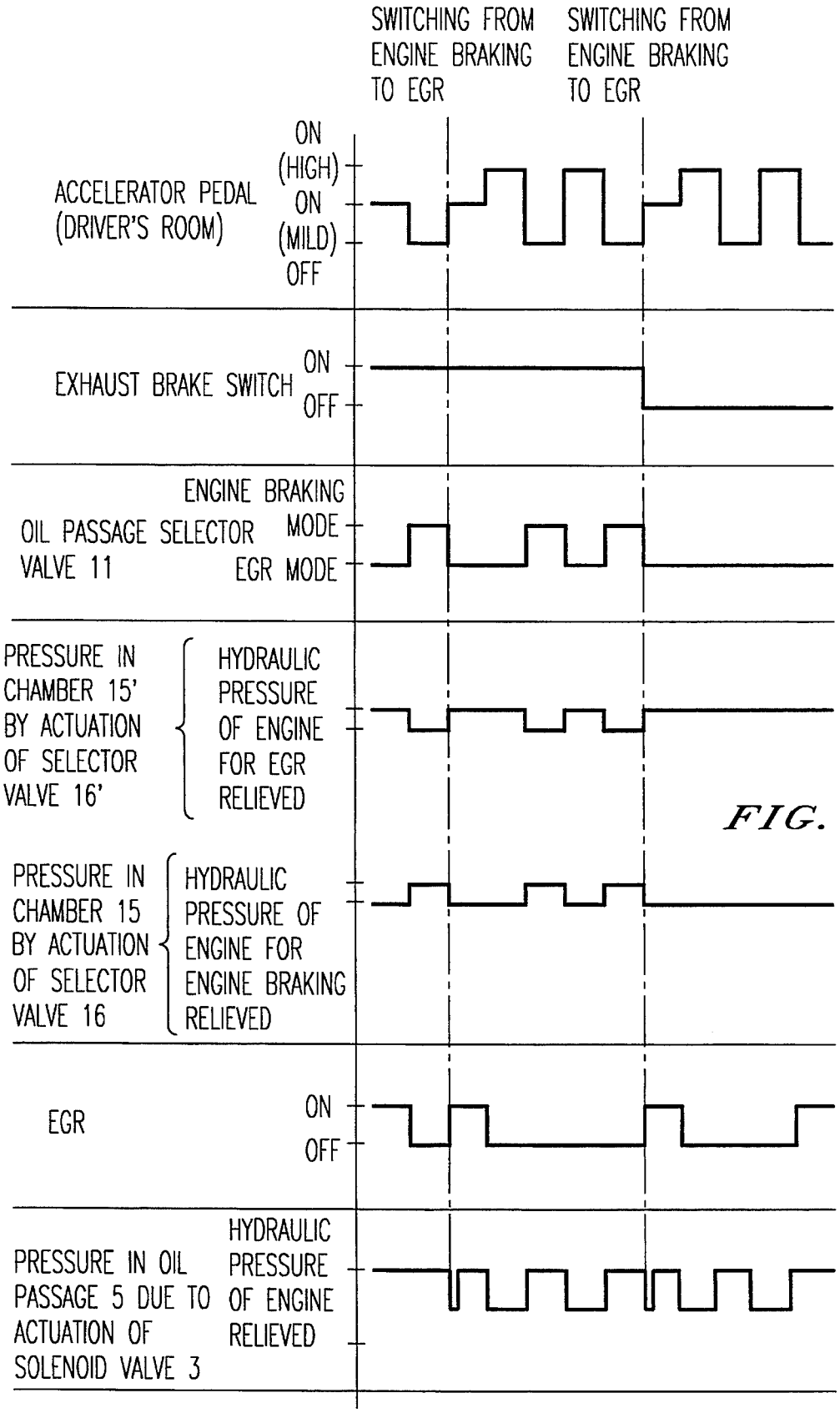
FIG. 7 is a chart showing the effect of accelerator pedal depression when using the embodiment of FIG. 6.
Figure 8:
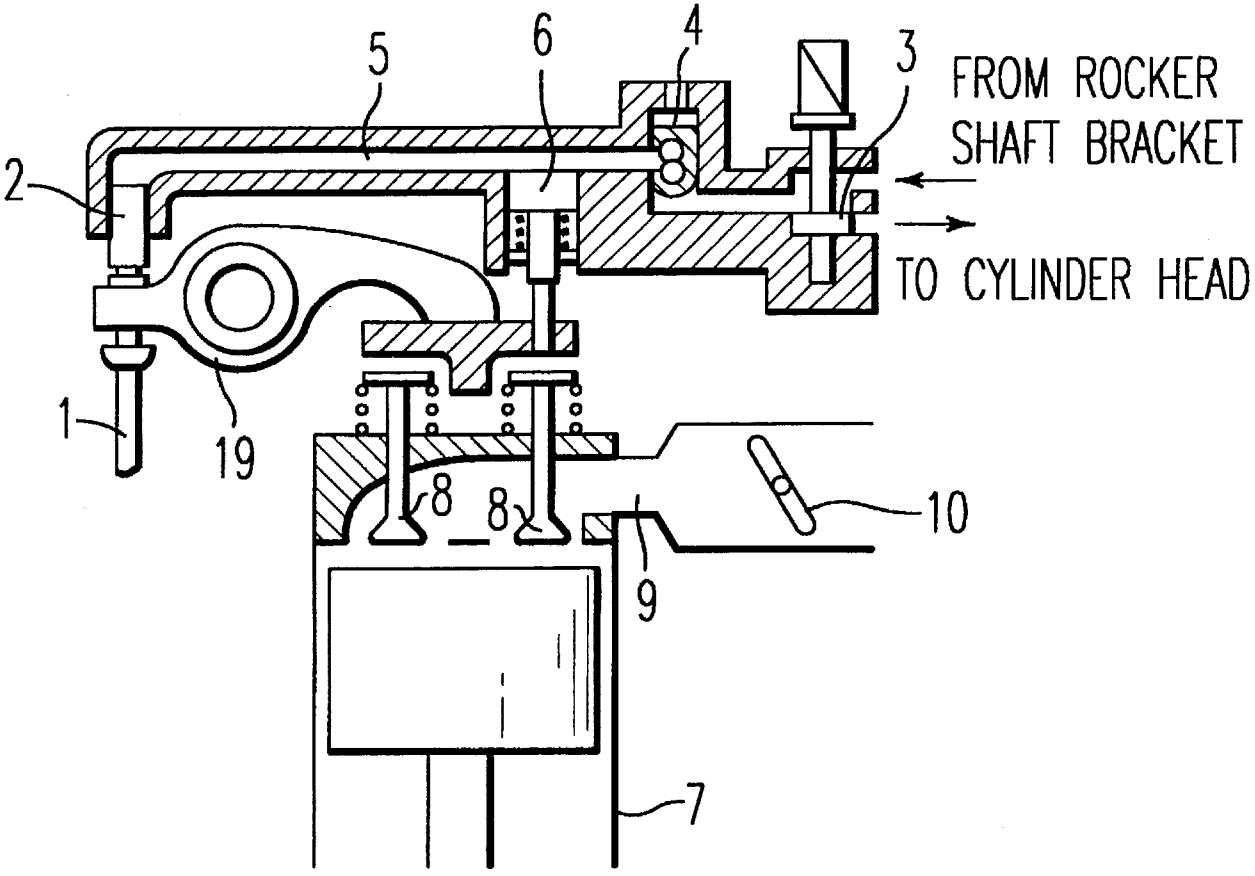
FIG. 8 is a sectional view showing an internal combustion engine with a conventional engine brake device.

FIGS. 6 and 7 show an arrangement for eliminating such possible confusion in which a control signal 18 for switching over the solenoid valve 3 to relieve the pressure in the oil passage 5 is outputted from a controller 17 to the solenoid valve 3 when the condition of no pressure on the accelerator pedal is changed into the low to moderate loading condition with the accelerator pedal being pressed to some extent, i.e., when the condition with the exhaust valve 8 being opened to effect engine braking is changed into the condition where engine braking mode is released and switched over to the EGR mode.

According to this arrangement, when the condition of the exhaust valve 8 being opened to effect engine braking is changed into the condition where ,engine braking is released and switched over to the EGR mode, the solenoid valve 3 is switched over by the control signal 18 from the controller 17 to relieve the pressure in the first oil passage 5. Engine braking due to the opening of the exhaust valve 8 near top dead center of the compression stroke is immediately released by the pressure relief in the first oil passage 5. Therefore, there is little chance of the driver becoming confused.

Of course, also in the embodiment of FIG. 1, just like the embodiment shown in FIGS. 6 and 7, the engine braking mode can be quickly switched over into, the EGR mode to eliminate the driver's confusion by an arrangement whereby the control signal 18 is outputted from the controller 17 to the solenoid valve 3 so as to switch over the solenoid valve 3 to relieve the pressure in the first oil passage 5 when the condition of no pressure on the accelerator pedal is changed into the low to moderate loading condition with the accelerator pedal being pressed to some extent, i.e., when the condition of the exhaust valve 8 being opened to effect engine braking is released and switched over to the EGR mode.

What is claimed as new and desired to be secured by letters patent of the United States is:

1. A four stroke internal combustion engine, comprising a first cylinder, a first master piston, a first rocker arm in engagement with said first master piston, a first oil passage supplied with oil under pressure, an exhaust valve and an exhaust port on said first cylinder, and a slave piston associated with said first cylinder, a first end of said slave piston communicating with said first oil passage and a second end of said slave piston arranged adjacent said exhaust valve; a first component associated with a second cylinder for actuating said first master piston through said first rocker arm when said first cylinder is near top dead center on a compression stroke; a second oil passage which may be selectively placed in communication with said first oil passage; a first end of said first master piston communicating with said second oil passage whereby when said first oil passage and said second oil passage communicate the actuation of said first master piston causes an increase in the pressure in said first and second oil passages to actuate said slave piston to open said exhaust valve as said first cylinder is near a top dead center position on a compression stroke resulting in the discharge of compressed gas through said exhaust port so that the energy used to compress the gas in said first cylinder is utilized to brake the engine without the loss that would occur due to a compressed gas return force; the improvement comprising a second master piston, a second rocker arm in engagement with said second master piston, said second master piston and said second rocker arm being associated with said first cylinder; a second component associated with said second cylinder for actuating said second master piston through said second rocker arm when said first cylinder is near bottom dead center on a suction stroke; a third oil passage which may be selectively placed in communication with said first oil passage; a first end of said second master piston communicating with said third oil passage whereby when said first oil passage and said third oil passage communicate the actuation of said second master piston causes an increase in the pressure in said first and third oil passages to actuate said slave piston to open said exhaust valve as said first cylinder is near a bottom dead center position on a suction stroke resulting in the flow of exhaust gases into said first cylinder; an oil passage selector valve arranged to selectively open communication between said second oil passage and said first oil passage or between said third oil passage and said first oil passage whereby when said oil passage selector valve is arranged to permit communication between said second oil passage and said first oil passage said first master piston effects operation of said slave piston and said exhaust valve is opened when the piston of said first cylinder is near a top dead center position on a compression stroke to enhance engine braking and when said oil selector valve is arranged to permit communication between said third oil passage and said first oil passage said second master piston effects operation of said slave piston and said exhaust valve is opened when said first cylinder is near bottom dead center on a suction stroke to effect exhaust-gas-recirculation into said first cylinder of the exhaust gas from another cylinder which is then on its exhaust stroke.

2. A four stroke internal combustion engine as set forth in claim 1 wherein said first component is an inlet push rod associated with said second cylinder and wherein said second component is an exhaust push rod associated with said second cylinder.

3. A four stroke internal combustion engine as set forth in claim 2 wherein said oil passage selector valve comprises a valve shaft, a first spool, and a second spool; said valve shaft being selectively movable between a first position and a second position, whereby in said first position of said valve shaft said first spool opens communication between said first oil passage and said second oil passage and said second spool closes communication between said first oil passage and said third oil passage, and whereby in said second position of said valve shaft said second spool opens communication between said first oil passage and said third oil passage and said first spool closes communication between said first oil passage and said second oil passage.

4. A four stroke internal combustion engine as set forth in claim 3 further comprising first control means including a brake switch having an off position and an on position, said first control means maintaining said oil passage selector valve in said second position when said brake switch is in said off position.

5. A four stroke internal combustion engine according to claim 4 further comprising an accelerator, said first control means maintaining said oil passage selector valve in said first position when said brake switch is on and no pressure is applied to said accelerator, and said control means maintaining said oil passage selector valve in said second position when mild or strong pressure is applied to said accelerator.

6. A four stroke internal combustion engine according to claim 5 comprising second control means for relieving the oil pressure in the first oil line in response to a signal indicating strong pressure is being applied to said accelerator.

7. A four stroke internal combustion engine according to claim 5 wherein said second control means relieves the oil pressure in said first oil passage in response to a signal indicating that the pressure on said accelerator has changed from no pressure to mild pressure.

8. A four stroke internal combustion engine according to claim 6 wherein said second control means relieves the pressure in said first oil passage in response to a signal indicating that the pressure on said accelerator has changed from no pressure to mild pressure.

* * * * *